US005964577A

United States Patent [19]

Chuang

[11] Patent Number: 5,964,577

[45] Date of Patent: Oct. 12, 1999

[54] HAND AIR PUMP WITH PIVOTABLE PRESSURE GAUGE

[76] Inventor: Louis Chuang, 7th Floor - 8, No. 20, Ta Lon Rd., Taichung, Taiwan

[21] Appl. No.: 08/951,746

[22] Filed: Oct. 16, 1997

[51] Int. Cl.[6] ..... F04B 49/00

[52] U.S. Cl. ..... 417/63; 73/756

[58] Field of Search ..... 417/63; 73/756, 73/744

[56] References Cited

U.S. PATENT DOCUMENTS

| | | | |
|---|---|---|---|
| 1,310,876 | 7/1919 | Savage et al. | 73/756 |
| 1,390,559 | 9/1921 | Huntley | 73/756 |
| 1,425,614 | 8/1922 | Stickel | 73/756 |
| 3,115,033 | 12/1963 | Blowers | 73/116 |
| 5,335,543 | 8/1994 | Hermansen | 73/431 |
| 5,779,457 | 7/1998 | Chuang et al. | 417/467 |

*Primary Examiner*—Charles G. Freay
*Assistant Examiner*—Robert Z. Evora
*Attorney, Agent, or Firm*—Charles E. Bazley, Esq.

[57] ABSTRACT

A hand air pump includes a cylinder having mutually communicated relatively large chamber and relatively small chamber, a mount sealingly mounted on the top of the cylinder and including an air passage communicated with the relatively small chamber, and a pressure gauge pivotally connected to the mount. The pressure gauge is pivotable between a storage a position and an operative position. In addition, the pressure gauge is communicated with the air passage at the storage position and at the operative position. A nozzle is communicated with the air passage for inflation.

5 Claims, 5 Drawing Sheets

HAND AIR PUMP WITH PIVOTABLE PRESSURE GAUGE

BACKGROUND OF THE INVENTION

1. Field of the Invention

The present invention relates to a hand air pump with a pivotable pressure gauge which can be pivoted to a position to save space during transportation or storage.

2. Description of the Related Art

A wide variety of hand air pumps have heretofore been provided for inflating bicycle tires, yet a common disadvantage thereof is that the pressure gauge occupies a space and thus is somewhat bulky during transportation and storage. This invention aims to overcome this difficulty by providing a pivotable pressure gauge.

SUMMARY OF THE INVENTION

It is an object of the present invention to provide a pivotable pressure gauge for hand air pumps to save space during transportation and storage without adversely affecting the pressure-indicating function thereof.

A hand air pump in accordance with the present invention comprises a cylinder having a relatively large chamber defined therein and a relatively small chamber defined therein and communicated with the relatively large chamber. A mount is sealingly mounted on the top of the cylinder and includes an air passage communicated with the relatively small chamber. A pressure gauge is pivotally connected to the mount in a manner that the pressure gauge is pivotable between a storage position and an operative position. In addition, the pressure gauge is communicated with the air passage at the storage position and at the operative position. A nozzle is communicated with the air passage for inflation.

In a preferred embodiment of the invention, the mount includes a pair of spaced ears formed on an outer periphery thereof and having aligned bores. The pressure gauge includes a lug having a bore in alignment with the bores of the ears, and a pin is extended through the bores of the ears and the lug to allow pivotal movement of the pressure gauge relative to the mount.

Preferably, the lug of the pressure gauge includes a first radial hole and a second radial hole defined therein and communicated with the pressure gauge, and the pin includes a transverse through hole defined therein and communicated with the air passage of the mount. The first radial hole aligns with the transverse through hole when the pressure gauge is in the operative position, and the second radial hole aligns with the transverse through hole when the pressure gauge is in the storage position.

A joint may be rotatably connected to the pin and include a passage intercommunicated with the nozzle and the air passage of the mount. The mount may further include a retainer formed on an outer periphery thereof for releasably receiving the nozzle.

Other objects, advantages, and novel features of the invention will become more apparent from the following detailed description when taken in conjunction with the accompanying drawings.

DESCRIPTION OF THE PREFERRED EMBODIMENT

Figure 1:
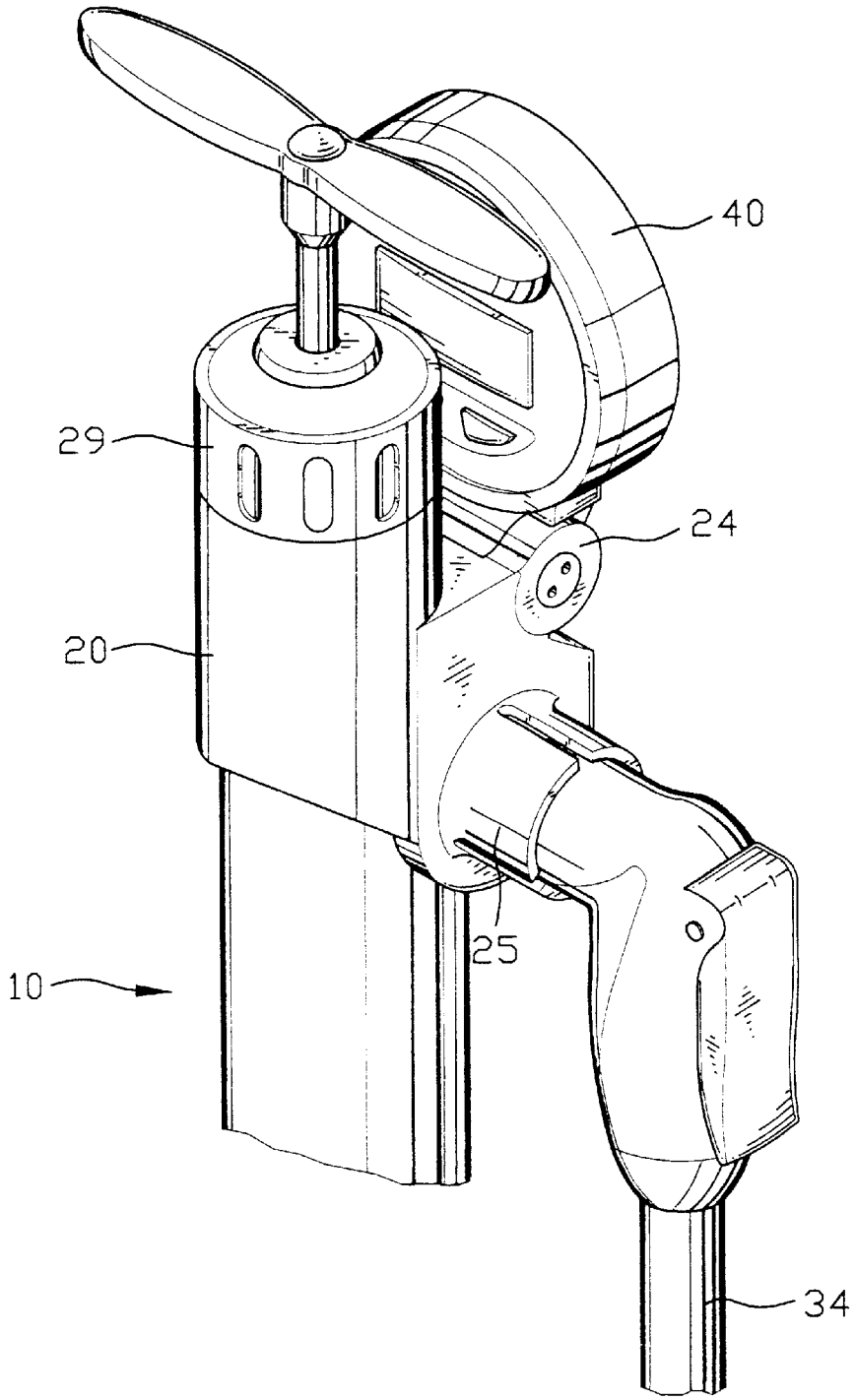
FIG. 1 is a perspective view of a portion of hand air pump in accordance with the present invention, wherein the pressure gauge is in a storage position.
Figure 2:
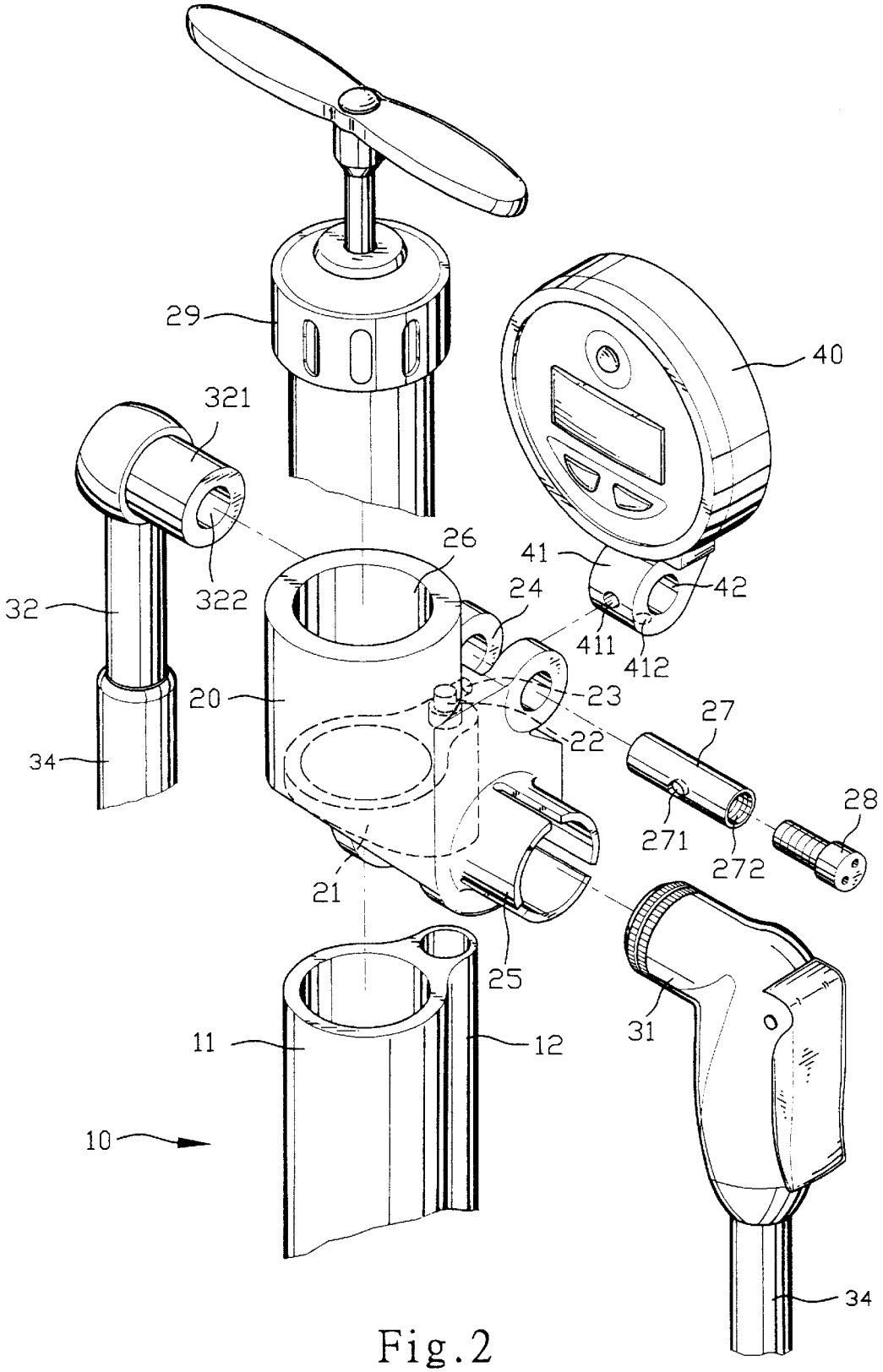
FIG. 2 is an exploded perspective view of the hand air pump in FIG. 1.

Referring to the drawings and initially to FIGS. 1 and 2, a hand air pump in accordance with the present invention generally includes a cylinder 10 having a relatively large chamber 11 and a relatively small chamber 12 defined therein, a mount 20 mounted on top of the cylinder 10, and a pressure gauge 40 pivotally connected to the mount 20. The mount 20 includes an upper recess 26 for receiving a head 29 which is connected to a handle (not shown) for manual inflation operation, which is conventional and therefore not further described. The mount 20 further includes a lower recess 21 defined in an underside thereof for sealingly receiving the top of the cylinder 10. In addition, the mount 20 includes an air passage having a vertical section 22 communicated with the relatively small chamber 12 and a horizontal section 23, which will be further described later. Further, the mount 20 includes a pair of spaced ears 24 having aligned bores (not labeled) formed on an outer periphery thereof. Also formed on the outer periphery of the mount 20 is a retainer 25, which will be further described later.

Formed on an outer periphery of the pressure gauge 40 is a lug 41 which includes a longitudinal bore 42 and two spaced radial holes 411 and 412 both of which are communicated with the bore 42 and the pressure gauge 40. The lug 41 is received between the ears 24, and a pin 27 is inserted through the aligned bore 42 of the lug 41 and the bores of the ears 24, thereby allowing pivotal movement of the pressure gauge 40 relative to the mount 20. A screw 28 is threadedly engaged with an inner threading 272 defined in an end of the pin 27 to prevent disengagement of the pin 27. The pin 27 further includes a transverse through hole 271 in alignment with the horizontal section 23 of the air passage. In addition, the transverse through hole 271 is communicated with one of the radial holes 411 and 412 which are communicated to the pressure gauge 40 for pressure indicating purpose.

The other end of the pin 27 extends beyond the ears 24, and a joint 32 is mounted to the other end of the pin 27 by an engaging section 321 and includes a passage 322 communicated with the transverse through hole 271. In addition, a nozzle 31 for inflation is connected to the joint 32 via a hose 34 and is releasably retained by the retainer 25.

Figure 3:
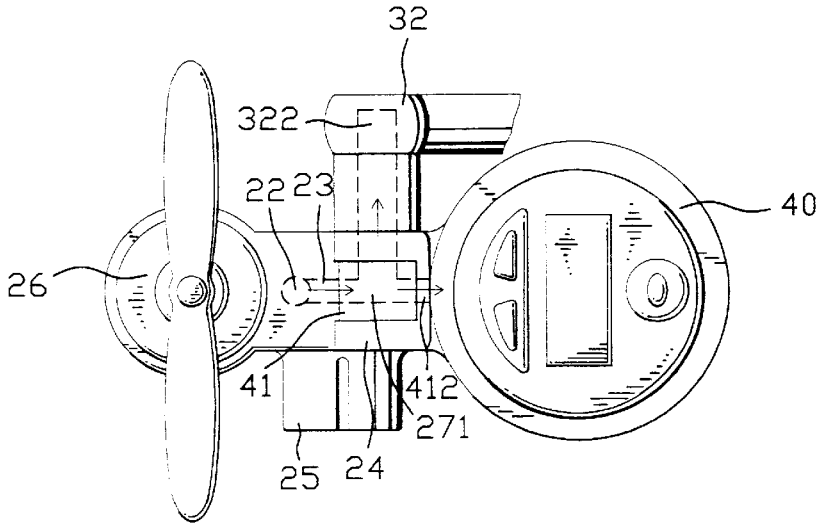
FIG. 3 is a schematic top view of the hand air pump.
Figure 4:
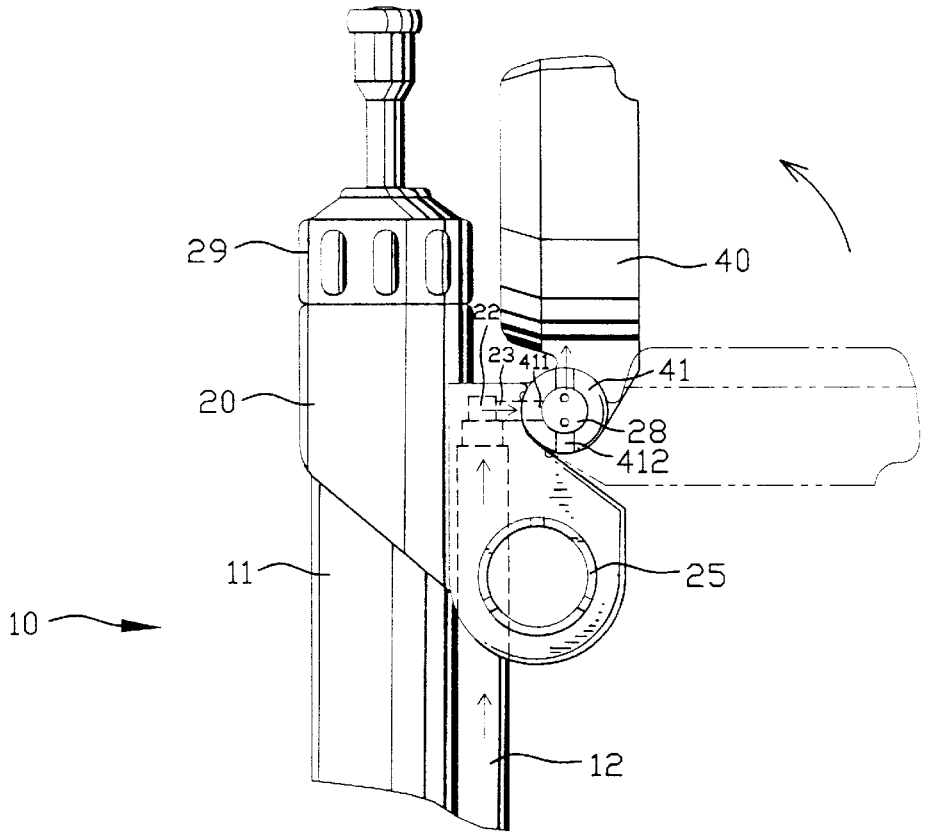
FIG. 4 is a schematic side view illustrating pivotal movement of the pressure gauge.
Figure 5:
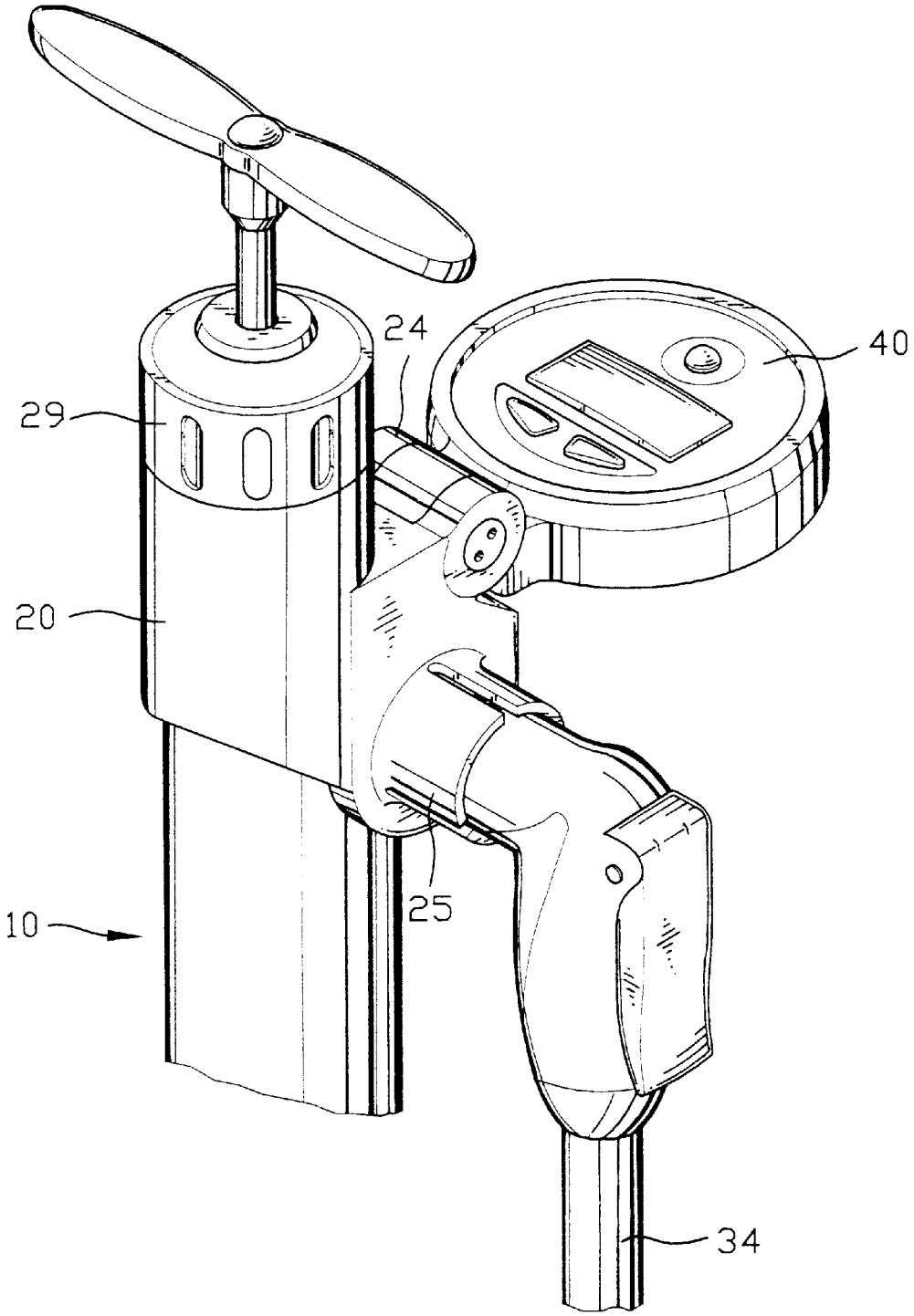
FIG. 5 is a a perspective view similar to FIG. 1, wherein the pressure gauge is in an operative position.
Figure 6:
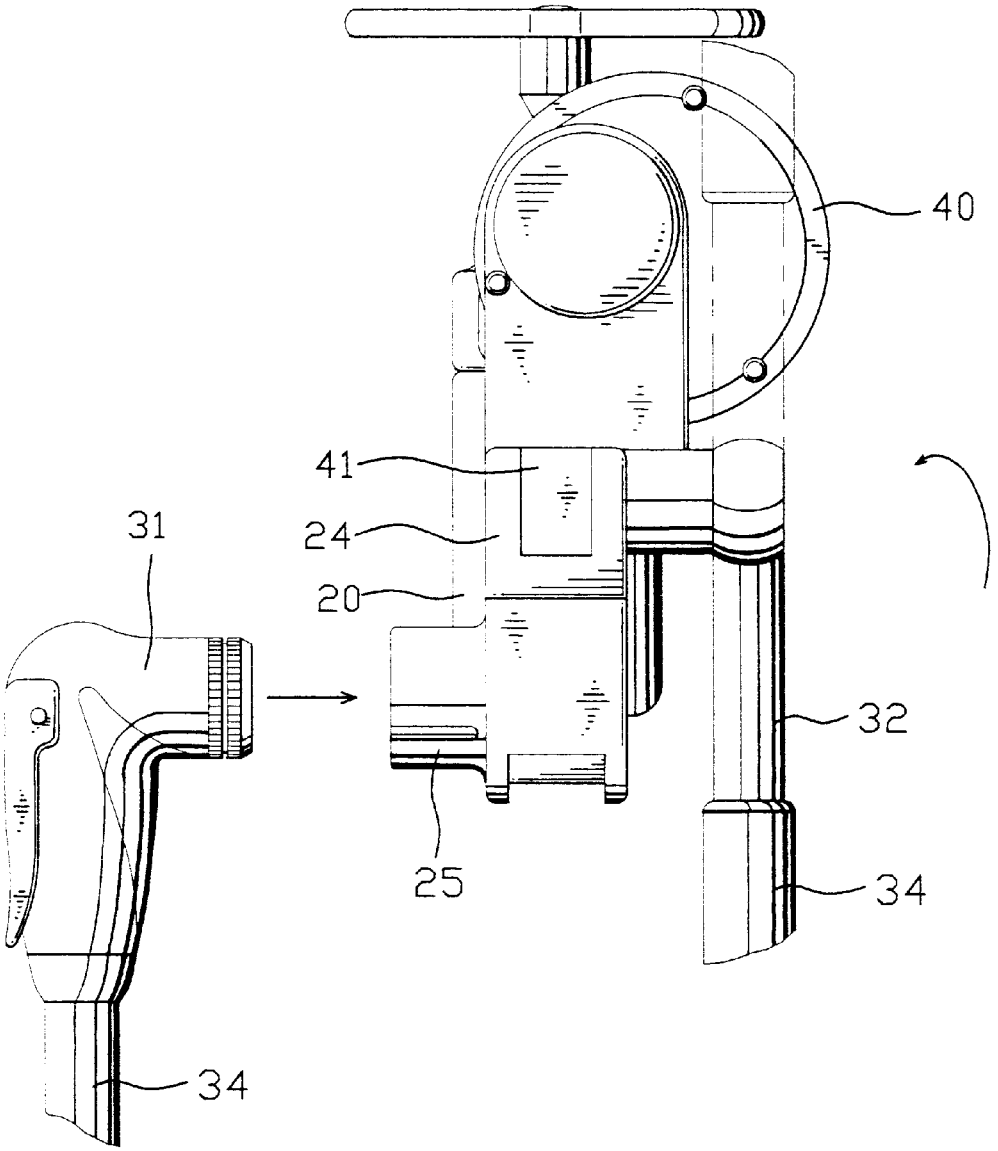
FIG. 6 is a side view of the hand air pump viewed from another direction.

When in use, the pressure gauge 40 is pivoted to a position shown in FIG. 5, in which the radial hole 412 is communicated with the relatively small chamber 12 via the air passage 22, 23. Operation of the handle causes air to flow from the relatively large chamber 11 into the relatively small chamber 12. The air, after passing through the air passage 22, 23, diverges into the pressure gauge 40 (via the transverse through hole 271 and the radial hole 412) to indicate the air pressure and the passage 322 which, in turn, is communicated with the nozzle 31 for inflation purpose, best shown in FIG. 3. As shown in FIG. 6, the joint 32 is rotatably engaged with the pin 27 to allow easy operation during inflation. In addition, when not in use, the nozzle 31 may be securely retained by the retainer 25. Referring to FIG. 4, the pressure gauge 40 may be pivoted to a vertical position for transportation or storage purpose, wherein the radial hole 411 is communicated with the transverse through hole 271 of the pin 27, i.e., the pressure gauge 40 is always in a sealing contact with the mount 20.

According to the above description, it is appreciated that the hand air pump in accordance with the present invention includes several advantages. First, the pressure gauge 40 is pivotable to a storage position such that the whole pump occupies a smaller space for transportation and storage. In addition, even in the storage position, the pressure gauge 40 is still communicated with relatively small chamber 12. Further, the joint 32 is rotatably engaged with the pin 27 such that the user may easily connect the nozzle 32 to a valve (not shown) of a bicycle tire (not shown) to be inflated.

Although the invention has been explained in relation to its preferred embodiment, it is to be understood that many other possible modifications and variations can be made without departing from the spirit and scope of the invention as hereinafter claimed.

What is claimed is:

1. A hand air pump comprising:

a cylinder having a relatively large chamber defined therein and a relatively small chamber defined therein and communicated with the relatively large chamber, the cylinder having a top, a mount sealingly mounted on the top of the cylinder and including an air passage communicated with the relatively small chamber, a pressure gauge pivotally connected to the mount, the pressure gauge being pivotable between a storage position and an operative position, the pressure gauge being communicated with the air passage at the storage position and at the operative position, and a nozzle communicated with the air passage for inflation.

2. The hand air pump according to claim 1, wherein the mount includes a pair of spaced ears formed on an outer periphery thereof and having aligned bores, and the pressure gauge includes a lug having a bore in alignment with the bores of the ears, and a pin is extended through the bores of the ears and the lug to allow pivotal movement of the pressure gauge relative to the mount.

3. The hand air pump according to claim 2, wherein the lug of the pressure gauge includes a first radial hole and a second radial hole defined therein and communicated with the pressure gauge, and the pin includes a transverse through hole defined therein and communicated with the air passage of the mount, the first radial hole aligns with the transverse through hole when the pressure gauge is in the operative position, and the second radial hole aligns with the transverse through hole when the pressure gauge is in the storage position.

4. The hand air pump according to claim 3, further comprising a joint rotatably connected to the pin and including a passage intercommunicated with the nozzle and the air passage of the mount.

5. The hand air pump according to claim 1, wherein the mount further includes a retainer formed on an outer periphery thereof for releasably receiving the nozzle.

* * * * *